US010273080B2

(12) United States Patent
Looker

(10) Patent No.: US 10,273,080 B2
(45) Date of Patent: Apr. 30, 2019

(54) AIR CARGO CONTAINER WITH SLIDING CURTAIN DOOR

(71) Applicant: Satco, Inc., El Segundo, CA (US)

(72) Inventor: Peter Looker, El Segundo, CA (US)

(73) Assignee: Satco, Inc., El Segundo, CA (US)

( * ) Notice: Subject to any disclaimer, the term of this patent is extended or adjusted under 35 U.S.C. 154(b) by 687 days.

(21) Appl. No.: 14/920,057

(22) Filed: Oct. 22, 2015

(65) Prior Publication Data

US 2017/0113870 A1 Apr. 27, 2017

(51) Int. Cl.

| | |
|---|---|
| ***B65D 88/14*** | (2006.01) |
| ***B65D 88/24*** | (2006.01) |
| ***B65D 90/58*** | (2006.01) |
| ***B65D 90/00*** | (2006.01) |
| ***B65D 90/02*** | (2019.01) |

(52) U.S. Cl.

CPC ..... *B65D 90/008* (2013.01); *B65D 88/14* (2013.01); *B65D 88/24* (2013.01); *B65D 90/021* (2013.01)

(58) Field of Classification Search

CPC ..... B65D 88/14; B65D 88/24; B65D 88/125; B65D 88/127; B65D 88/1637; B65D 88/58; B65D 90/587; B65D 90/021; B65D 90/008; B65D 90/0086; B65D 90/029; B65D 90/56; B65D 90/54; B65D 90/582; B65D 90/585; B65D 90/545; B65D 90/58; B65D 2590/545; Y10S 206/816

See application file for complete search history.

(56) References Cited

U.S. PATENT DOCUMENTS

| | | | | |
|---|---|---|---|---|
| 3,853,239 | A | 12/1974 | Meller et al. | |
| 4,250,987 | A | 2/1981 | Trammell et al. | |
| 4,538,663 | A | 9/1985 | Looker | |
| 5,180,078 | A | 1/1993 | Looker | |
| 5,319,880 | A | 6/1994 | Kuhlman | |
| 5,337,425 | A * | 8/1994 | Hill | A47K 3/38 160/330 |
| 5,570,801 | A | 11/1996 | Younger | |
| 5,601,201 | A | 2/1997 | Looker | |
| 5,667,002 | A | 9/1997 | Neustadt | |
| 6,755,232 | B1 * | 6/2004 | Holland | B65D 88/125 160/368.1 |
| 7,063,227 | B2 | 6/2006 | Looker | |
| 7,393,034 | B2 | 7/2008 | Brussard et al. | |
| 8,479,801 | B2 | 7/2013 | Holland et al. | |
| 2005/0150169 | A1 | 7/2005 | Schulte et al. | |
| 2012/0118882 | A1 * | 5/2012 | Holland | B65D 88/127 220/1.5 |

FOREIGN PATENT DOCUMENTS

| | | | | |
|---|---|---|---|---|
| DE | 2119536 | A1 * | 10/1972 | B65D 7/24 |
| DE | 19514587 | A1 * | 10/1996 | B60J 5/065 |

OTHER PUBLICATIONS

DE_2119536_translation.pdf.*
DE_19514587_translation.pdf.*

* cited by examiner

*Primary Examiner* — Allan D Stevens
(74) *Attorney, Agent, or Firm* — Perkins Coie LLP; Kenneth H. Ohriner

(57) ABSTRACT

An air cargo container has a tubular head rail extending across the front opening of the container. Sliders are provided in or on the head rail. A curtain door has sheet of flexible material and flexible straps attached to the sheet. The straps are attached to the sliders. The curtain door may be opened and closed via the sliders sliding along the head rail.

16 Claims, 4 Drawing Sheets

AIR CARGO CONTAINER WITH SLIDING CURTAIN DOOR

BACKGROUND OF THE INVENTION

Air cargo containers have been used for the transportation of cargo by aircraft for many years. Cargo such as cartons, smaller shipping containers, etc. is first loaded into containers. The containers are then loaded into an aircraft. Use of air cargo containers is much faster than loading cargo directly into the cargo space of the aircraft, since the individual cartons need not be separately placed and secured within the aircraft. Air cargo containers can also be loaded at locations remote from the airport. Furthermore, because the cargo containers are typically designed and constructed to correspond to the interior dimensions of the aircraft cargo space, the containers fit more securely in the cargo space and do not shift during flight. These and other advantages of air cargo containers have made air cargo containers widely used in the air freight and airline industry.

A door is typically provided over an opening in the front wall of the container so that cargo may be loaded into, and unloaded out of, the container. Typically the door is a flexible so-called curtain door, often provided with reinforcing straps. The door slides to one side, like a window curtain, to uncover the opening in the front wall, for loading and unloading cargo. Although these designs have worked well in the past, sliding the door can sometimes become difficult, especially if cargo has shifted during transport applying significant tension to the door. Accordingly, engineering challenges remain in the design of air cargo containers.

SUMMARY OF THE INVENTION

An air cargo container has a head rail extending between the left and right walls, and a curtain door supported by or suspended on a plurality of sliders within the head rail. The head rail may be a square or rectangular tube having a bottom wall, and a slot in the bottom wall, and with a part of each slider in the slot. A tab or riser is optionally provided and extends down from a bottom surface of the slider into the slot. The sliders provide a high-strength attachment for the curtain door and also allow the curtain door to slide easily.

DETAILED DESCRIPTION OF THE DRAWINGS

Figure 1:
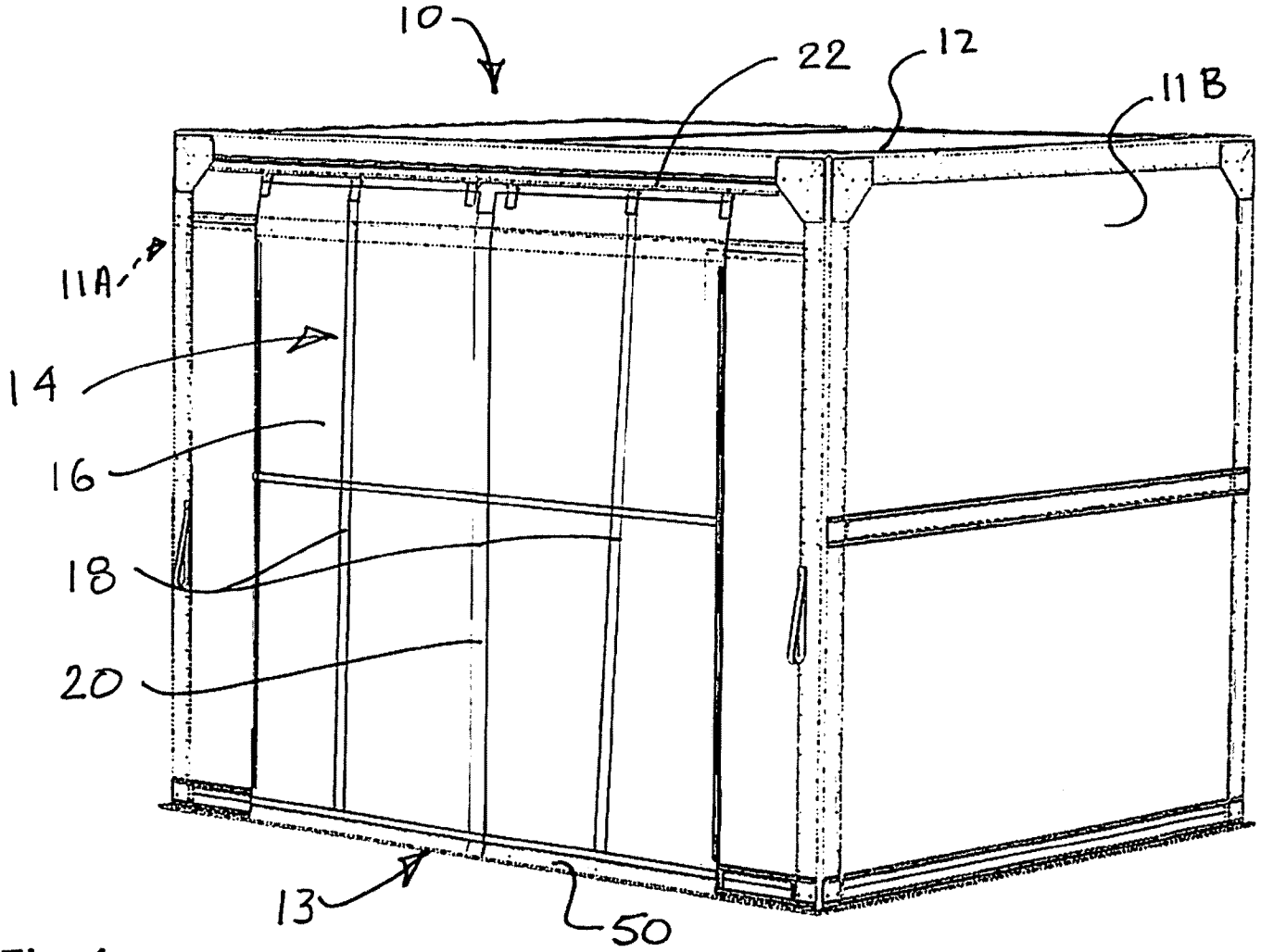
FIG. 1 is a perspective view of an air cargo container.

As shown in FIG. 1, an air cargo container 10 has left and right walls 11A, 11B, a top 12, a floor 13 and a rear wall, with the walls attached to the top and the floor. A curtain door 14 is provided over a front opening of the container 10. Typically the curtain door 14 is made of a strong and flexible sheet of material 16, with straps 18 stitched into, onto or otherwise attached to the flexible sheet 16.

Figure 2:
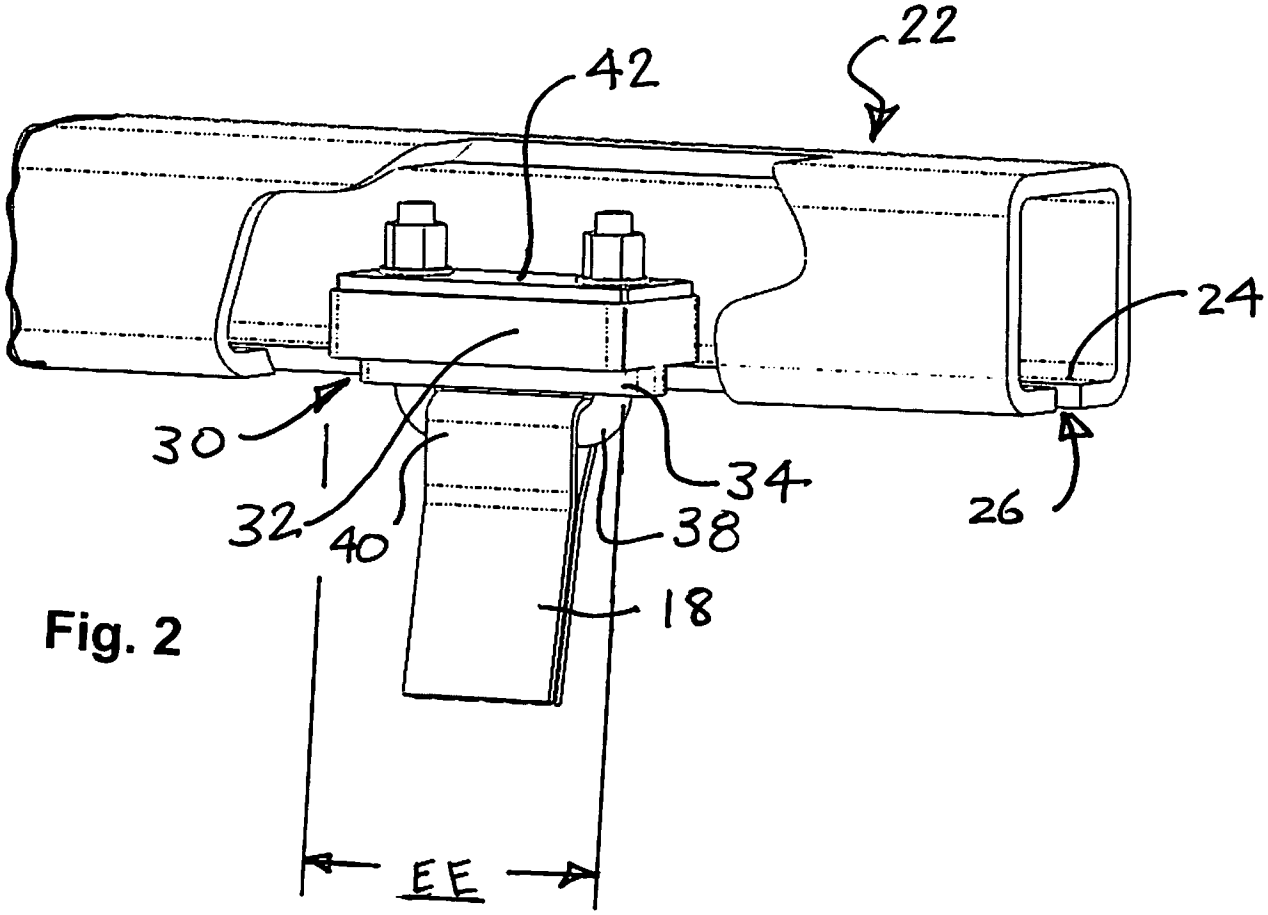
FIG. 2 is a perspective cutaway view of the head rail and one slider of the air cargo container shown in FIG. 1.
Figure 3:
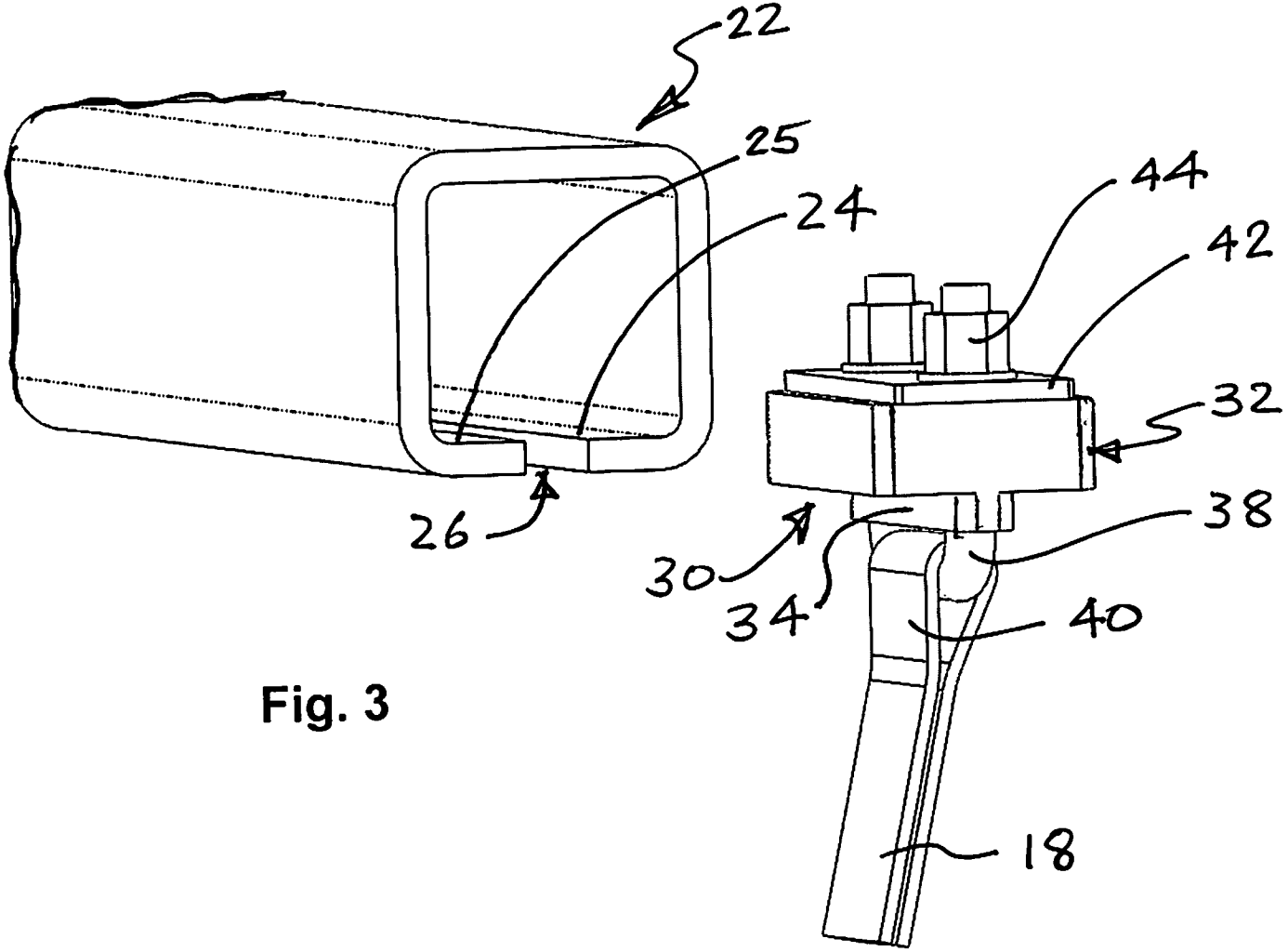
FIG. 3 is an exploded perspective view of the head rail and slider shown in FIG. 2.
Figure 4:
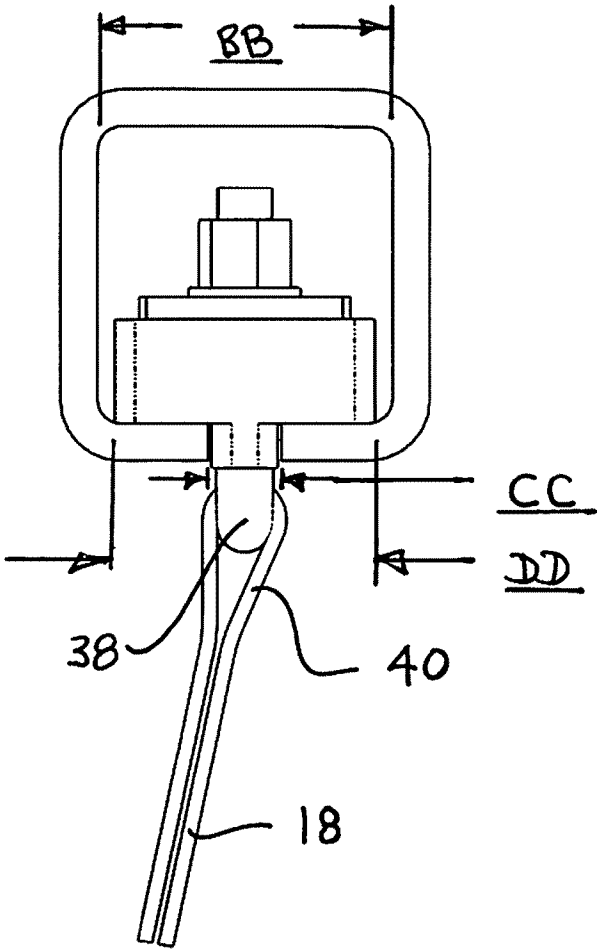
FIG. 4 is an end view of the head rail and slider shown in FIG. 2.

Turning to FIG. 2, a head rail 22 is provided on the container above the front opening. The head rail 22 is typically a square or rectangular extruded aluminum tube. A slot 26 is provided in the bottom or down facing wall of the head rail 22 between front and rear bottom rail surfaces 25 and 24 shown in FIG. 3. The curtain door 14 is slidably supported by the head rail 22 via sliders 30 in the head rail 22 attached to the straps 18. As shown in FIGS. 2-4, each slider 30 has a body 32 largely within the head rail 22. The body 32 may be square or rectangular, and the body may be made of a low friction material, such as various plastics, polypropylene, polyethylene, and synthetic fluoropolymers such as polytetrafluoroethylene. Alternatively, the body of the slider may metal or other material with only a low friction material on the bottom surface which slides on the head rail. The head rail 22 may have an inside width and a diagonal dimension of the body 32 of the slider 30 extending between opposite corners of the body is greater than the inside width, to substantially prevent the body from rotating in the head rail.

A riser or protrusion 34 may extend down from the body 32 into the slot 26, to keep the slider 30 aligned with the longitudinal axis of the head rail 22. In this case, as shown in FIG. 4, the width CC of the riser 34 is nominally less than the width of the slot 26. Alternatively, the riser 34 may be omitted and the body 32 may be dimensioned with a width DD nominally less than the width BB of the channel formed in the head rail, as shown in FIG. 4, after accounting for the inner radii of the channel. The length EE of the body 32 shown in FIG. 2 is generally 1.5 to 3 times the width DD of the body shown in FIG. 4, although other designs, including square bodies may also be used.

As shown in FIGS. 2 and 3, the upper end of each strap 18 may be formed into a loop 40, with a fastener, such as a U-bolt 38 having straight threaded legs joined to a U-section, attaching the loop 40 to the slider 30. If used, the U-bolt 38 or other fastener may extend through the body 32, including through the riser 34, if any, with nuts 44 on the threaded legs securing the U-bolt 38 onto the body 32.

A backing plate 42 is provided between the nuts 44 and the body 32 to better distribute compression forces on the body 32. The backing plate 42, typically made of metal or other material of higher strength than the low friction material body. The backing plate, for example a 2-6 mm thick steel or aluminum plate, allows the body of the slider to be made of a low-friction material for smooth sliding operation, while still maintaining the structural integrity of the door. During normal operations the backing plate 42 does not carry significant load. However, under extreme load conditions, such as during air turbulence or a hard landing, the low-friction material may yield. The load is then carried primarily via the backing plate 42 to the head rail.

Referring back to FIG. 1, generally the door 14 is split into left and right sections which can be pulled apart to open the container 10, with the left and right sections sliding outwardly towards the left and right ends of the head rail 22. As friction between the head rail 22 and the sliders 30 is minimal, the sections are easily moved, even with very tall containers were the sections are necessarily pulled at a steep angle. Generally two to four spaced apart vertical straps 18 are provided on each section. FIG. 1 shows the left and right sections in the closed position, with a closure 20 securing the inner edges of the sections together. The closure 20 may be Velcro hook and loop tape other mechanical attachment fitting. Alternatively, the door 14 may be a single section with one side optionally fixed to the structure of the container 10 and with the other side slidable substantially across the entire width of the opening.

The container 10 may also have a foot rail 50 at the front opening, at or near the floor 13. In this case, the lower ends of the straps 18 can be attached to the foot rail 50 using detachable fittings or hooks, so that both the top and bottom of the door 14 can be securely attached to the structure of the container during transit.

Thus, a novel air cargo container has been shown and described. Various changes and modifications may of course be made without departing from the spirit and scope of the invention. The invention, therefore, should not be limited, except by the following claims and their equivalents.

The invention claimed is:

1. An air cargo container, comprising:

a left wall and a right wall each attached to a floor;

a rear wall attached to each of the left and right walls and to the floor;

a top attached to each of the rear wall and to the left and right walls;

a head rail extending between the left and right walls, adjacent to the top, the head rail having a slot facing the floor;

a curtain door comprising a sheet of flexible material and a plurality of straps attached to the sheet of flexible material; and a plurality of sliders, with each slider of the plurality of sliders attached respectively to one of the straps of the plurality of straps, and with each slider having a flat bottom surface slidably supported within the head rail, and, each slider having a square or rectangular body comprising a plastic material, and a metal backing plate on the body.

2. The air cargo container of claim 1 with the head rail comprising a square or rectangular tube having a bottom wall, and the slot in the bottom wall, and with a part of each slider in the slot.

3. The air cargo container of claim 2 with each slider having the body having a front surface parallel to a back surface, and a left surface parallel to a right surface, and with the front and back surfaces perpendicular to the left and right side surfaces, a top surface and a bottom surface, and the part of each slider in the slot comprising a rectangular riser extending downward from the bottom surface of the body into the slot.

4. The air cargo container of claim 3 wherein the head rail has an inside width and a diagonal dimension of the body of the slider extending between opposite corners of the body is greater than the inside width to prevent the body from rotating in the head rail.

5. The air cargo container of claim 4 with the riser having width adapted to fit into the slot, to allow the slider to slide in the head rail while maintaining the riser parallel to the slot.

6. The air cargo container of claim 5 further comprising a plurality of loops, with each loop of the plurality of loops at an end of one of the straps of the plurality of straps, respectively, and with each loop of the plurality of loops attached to one of the sliders of the plurality of sliders, respectively.

7. The air cargo container of claim 6 with the loop attached to the slider via a U-bolt having threaded ends extending through the riser and the body and secured via a nut on each threaded end at the top surface of the body.

8. The air cargo container of claim 5 further comprising a foot rail extending between the left and right walls adjacent to the floor.

9. The air cargo container of claim 3 with the body of the slider having a length (EE) and a width (DD), wherein the length (EE) is at least 1.5 times greater than the width (DD), and wherein the riser has a width (CC) with the slot having a width 0.025 to 1 mm greater than the width (CC) of the riser.

10. The air cargo container of claim 1 with the curtain door split into a first section on a left side of the head rail and a second section on a right side of the head rail, and further including a closure for attaching the first section to the second section.

11. An air cargo container, comprising:

three walls, a floor and a top providing an enclosure having a front opening;

a head rail extending across a width of the front opening, with the head rail comprising a square or rectangular tube having front and rear bottom surfaces spaced apart by a slot;

a sheet of flexible material and a plurality of flexible straps attached to the sheet of flexible material; and a plurality of non-metal sliders in or on the head rail;

each slider including a fastener having a first end attached to a strap and a second end extending through that slider and holding a backing plate onto that slider.

12. The air cargo container of claim 11 with a part of each slider in the slot.

13. The air cargo container of claim 11 wherein each slider has a square or rectangular body and the part of each slider in the slot comprises a rectangular riser extending downward from a bottom surface of the body into the slot.

14. The air cargo container of claim 11 wherein the head rail has an inside width (BB) and the body of the slider has a width (DD) equal to 85 to 95% of (BB).

15. An air cargo container, comprising:

three walls, a floor and a top providing an enclosure having a front opening;

a head rail extending across the front opening, with the head rail comprising a square or rectangular tube having front and rear bottom surfaces spaced apart by a slot;

a sheet of flexible material dimensioned to cover the front opening, and a plurality of flexible straps attached to the sheet of flexible material;

a plurality of non-metal sliders in or on the head rail;

each slider having a U-bolt including threaded straight legs joined to a U-section, with the legs extending through the slider and through a backing plate on the slider, and with one of the plurality of flexible straps looped around the U-section.

16. The air cargo container of claim 15 with each slider having a square or rectangular body and a rectangular riser extending downward from a bottom surface of the body into the slot.

* * * * *